US009327320B1

(12) United States Patent
Coolidge et al.

(10) Patent No.: US 9,327,320 B1
(45) Date of Patent: May 3, 2016

(54) APPARATUS AND METHOD FOR COAL DEDUSTING

(71) Applicant: Green Search, LLC, Las Vegas, NV (US)

(72) Inventors: Dennis W. Coolidge, Palm Coast, FL (US); Richard A. Kindt, Toledo, OH (US); Kerry B. Tausch, Winter Garden, FL (US)

(73) Assignee: Green Search, LLC, Las Vegas, NV (US)

( * ) Notice: Subject to any disclaimer, the term of this patent is extended or adjusted under 35 U.S.C. 154(b) by 0 days.

(21) Appl. No.: 14/608,822

(22) Filed: Jan. 29, 2015

(51) Int. Cl.
*B07B 4/00* (2006.01)
*B07B 4/08* (2006.01)

(52) U.S. Cl.
CPC ..... *B07B 4/08* (2013.01)

(58) Field of Classification Search
CPC ..... B07B 4/00; B07B 4/06; B07B 4/08
USPC ..... 209/21, 22, 28, 44.2, 136, 137, 644
See application file for complete search history.

(56) References Cited

U.S. PATENT DOCUMENTS

| | | | | |
|---|---|---|---|---|
| 1,814,980 | A | 7/1931 | Thomas | |
| 1,959,125 | A * | 5/1934 | Davis | B03B 4/02 209/467 |
| 1,976,908 | A | 10/1934 | Wittenberg | |
| 2,029,883 | A | 2/1936 | MacCubbin et al. | |
| 2,040,100 | A | 5/1936 | Miller | |
| 2,044,764 | A | 6/1936 | Bywater | |
| 2,260,072 | A | 10/1941 | Wilton | |
| 2,366,900 | A | 1/1945 | Weir | |
| 2,528,553 | A | 11/1950 | Royster | |
| 2,639,409 | A | 5/1953 | Cobine | |
| 2,666,796 | A | 1/1954 | Gorin et al. | |
| 2,748,063 | A | 5/1956 | Radasch et al. | |
| 2,774,716 | A | 12/1956 | Kulik | |
| 3,010,893 | A | 11/1961 | Kulik | |
| 3,375,175 | A | 3/1968 | Eddinger et al. | |
| 3,463,310 | A | 8/1969 | Ergun et al. | |
| 3,574,065 | A | 4/1971 | Eddinger et al. | |
| 3,585,732 | A | 6/1971 | Itahashi | |
| 3,736,233 | A | 5/1973 | Sass et al. | |
| 3,938,966 | A | 2/1976 | Kindig et al. | |
| 4,028,219 | A | 6/1977 | Baldwin et al. | |
| 4,036,603 | A | 7/1977 | Bernet et al. | |
| 4,052,170 | A | 10/1977 | Yan | |
| 4,119,523 | A | 10/1978 | Baldwin et al. | |
| 4,146,367 | A | 3/1979 | Hsu | |
| 4,149,939 | A | 4/1979 | Solano | |

(Continued)

OTHER PUBLICATIONS

Berkowitz, "An Introduction to Coal Technology", 1994, 2nd Edition, pp. 102-103; 164-165.

(Continued)

*Primary Examiner* — Terrell Matthews
(74) *Attorney, Agent, or Firm* — MacMillan, Sobanski & Todd, LLP

(57) ABSTRACT

An apparatus and a method for dedusting coal or other material are described. The apparatus and method involve the coal or other material moving down a declined sliding bed composed of slats through which air or gas is blown to provide an air or gas cushion. Dust particles are lofted so as to separate dust from the material. Either or both of the dust and the resulting dedusted material can be collected.

24 Claims, 6 Drawing Sheets

(56) References Cited

U.S. PATENT DOCUMENTS

| | | | | |
|---|---|---|---|---|
| 4,156,595 | A | 5/1979 | Scott et al. | |
| 4,213,826 | A | 7/1980 | Eddinger et al. | |
| 4,234,386 | A | 11/1980 | Stirling | |
| 4,263,124 | A | 4/1981 | Wickstrom et al. | |
| 4,322,222 | A | 3/1982 | Sass | |
| 4,341,598 | A | 7/1982 | Green | |
| 4,395,309 | A | 7/1983 | Esztergar | |
| 4,411,766 | A | 10/1983 | Garg et al. | |
| 4,411,767 | A | 10/1983 | Garg | |
| 4,466,362 | A | 8/1984 | Maxwell et al. | |
| 4,534,847 | A | 8/1985 | Roberts et al. | |
| 4,605,790 | A | 8/1986 | Wojtkowski | |
| 4,652,362 | A * | 3/1987 | Mueller | B03B 4/02 209/312 |
| 4,678,478 | A | 7/1987 | Kelland | |
| 4,768,446 | A | 9/1988 | Wilkes et al. | |
| 4,834,650 | A | 5/1989 | Docherty et al. | |
| 4,961,389 | A | 10/1990 | Pillsbury | |
| 5,017,283 | A | 5/1991 | Oder | |
| 5,087,269 | A | 2/1992 | Cha et al. | |
| 5,114,700 | A | 5/1992 | Meihack et al. | |
| 5,127,586 | A | 7/1992 | Oder | |
| 5,151,159 | A | 9/1992 | Wolfe et al. | |
| 5,171,406 | A | 12/1992 | Shang et al. | |
| 5,176,260 | A | 1/1993 | Oder | |
| 5,199,448 | A * | 4/1993 | Parker | A24B 1/04 131/110 |
| 5,240,592 | A | 8/1993 | Meyer et al. | |
| 5,244,099 | A * | 9/1993 | Zaltzman | A01D 33/04 209/466 |
| 5,326,457 | A | 7/1994 | Stipanovich, Jr. | |
| 5,372,497 | A | 12/1994 | Coolidge et al. | |
| 5,373,648 | A | 12/1994 | Wolf | |
| 5,401,364 | A | 3/1995 | Rinker | |
| 5,496,465 | A | 3/1996 | Fraas | |
| 5,547,549 | A | 8/1996 | Fraas | |
| 5,601,692 | A | 2/1997 | Rinker et al. | |
| 5,657,902 | A * | 8/1997 | Kraus | B65G 65/44 198/532 |
| 5,711,769 | A | 1/1998 | Rinker et al. | |
| 5,730,069 | A | 3/1998 | Coolidge et al. | |
| 5,997,289 | A | 12/1999 | Dover | |
| 6,203,761 | B1 * | 3/2001 | Paatz | B01J 2/16 34/585 |
| 6,467,631 | B2 * | 10/2002 | Strangalies | B03B 4/005 209/474 |
| 7,540,384 | B2 * | 6/2009 | Ness | B03B 4/06 209/133 |
| 7,708,145 | B2 * | 5/2010 | Li | B03B 4/02 209/471 |
| 8,372,185 | B2 * | 2/2013 | Bullinger | B03B 4/06 209/133 |
| 8,470,134 | B2 | 6/2013 | Rinker | |
| 2003/0118962 | A1 | 6/2003 | Munzner et al. | |
| 2004/0065307 | A1 | 4/2004 | Fiveland et al. | |
| 2007/0272538 | A1 | 11/2007 | Satchell | |
| 2008/0116052 | A1 | 5/2008 | Eatough et al. | |
| 2009/0119981 | A1 | 5/2009 | Drozd et al. | |
| 2011/0011719 | A1 | 1/2011 | Rinker | |
| 2011/0011720 | A1 | 1/2011 | Rinker | |

OTHER PUBLICATIONS

Dadayburjor et al., "Coal Conversion Processes Liquefaction," Kirk-Othmer Encyclopedia of Chemical Technology, 2003, vol. 6, pp. 851-856.

Kreith, "Principles of Heat Transfer", 2nd Edition, 1965, pp. 236-238.

Mahajan et al., "Low-temperature Air Oxidation of Caking Coals. 1. Effect on subsequent reactivity of chars produced", FUEL, 1980, vol. 59, pp. 3-10.

Oder, Dry Magnetic Separation of Ash, Sulfur and Mercury From a Southwestern Wyoming Coal, presented at the 18th International Low Rank Fuels Symposium, Jun. 24-26, 2003, Billings, Mt, pp. 1-6.

International Search Report and Written Opinion, Application No. PCT/US2010/041918, Dated Feb. 24, 2011.

International Search Report and Written Opinion, Application No. PCT/US11/51927, Dated Mar. 27, 2012.

International Search Report, Application No. PCT/US2012/039598, Dated Dec. 28, 2012.

International Search Report, Application No. PCT/US2012/044880, dated Jan. 29, 2013.

Written Opinion of the International Searching Authority, Application No. PCT/US2012/039598, Dated Dec. 28, 2012.

Written Opinion, Application No. PCT/US2012/044880, dated Jan. 29, 2013.

* cited by examiner

APPARATUS AND METHOD FOR COAL DEDUSTING

RELATED APPLICATIONS

None.

BACKGROUND OF THE INVENTION

Coal is the base material for the production of many valuable products, as well as energy. However, coal dust can be problematic. For instance, coal dust creates a cloud that makes the loading of coal onto rail cars more difficult. Therefore, it is sometimes desirable to effectively remove the dust from coal. Particles sized 75 μm or less are the most susceptible to lofting, and therefore constitute the bulk of the dusting problem with coal. Thus, it would be especially beneficial to remove 75 μm and smaller particles from coal.

SUMMARY OF THE INVENTION

Provided is an apparatus for handling coal or other material. The apparatus includes an elongated enclosure with side walls, a top portion with a top wall, and a bottom portion with a bottom wall, and has an inlet end for receiving material with an inlet gate and outlet end with an outlet gate. The enclosure houses a sliding bed that separates the top portion from the bottom portion. The sliding bed is composed of a plurality of slats that extend laterally between the side walls from the inlet end to the outlet end. The sliding bed is disposed at an acute angle declined from the horizontal in the direction from the inlet end to the outlet end, and each of the inlet gate and outlet gate is moveable between an open position and a closed position. An air movement apparatus is configured to generate a zone of pressure atop the slats. A discharge plenum is at the outlet end through the outlet gate, configured to receive material exiting the enclosure, and a dust outlet in communication with the discharge plenum or the enclosure, where the dust outlet is configured to direct lofted material exiting the enclosure to a desired location. A collection apparatus is in communication with the discharge plenum, configured to collect non-lofted material exiting the discharge plenum.

In certain embodiments, the apparatus further includes a feed hopper in communication with the inlet end through the inlet gate, the feed hopper being configured to deliver material onto the sliding bed when the inlet gate is in the open position.

In certain embodiments, the air movement apparatus includes a blower configured to deliver air or gas flow into the enclosure through one or more blower ports in the bottom portion of the enclosure. In particular embodiments, the blower has a fan capacity of at least 6000 ACFM. In particular embodiments, the blower is connected to the blower ports through spiral wound ducts.

In certain embodiments, the apparatus further includes a plurality of tines on the sliding bed, the tines being configured to slow movement of material along the sliding bed. In certain embodiments, the dust outlet is connected to a bag house through a dust duct. In certain embodiments, the acute angle is from about 20 degrees to about 50 degrees declined from the horizontal in the direction from the inlet end to the outlet end.

Further provided is an apparatus for dedusting coal or other material, the apparatus including an enclosure with two or more modular sections, an inlet end for receiving material with an inlet gate, and an outlet end with an outlet gate. The enclosure houses a sliding bed that extends laterally from the inlet end to the outlet end and is composed of a plurality of slats. Each modular section has a lower portion and an upper portion separated by the sliding bed, the sliding bed being configured at an acute angle declined from the horizontal in the direction from the inlet end to the outlet end. Each of the inlet gate and the outlet gate is moveable between an open position and a closed position. An air movement apparatus is configured to generate a zone of pressure atop the slats in at least one of the two or more modular sections. A discharge plenum is in communication with the outlet end through the outlet gate such that material exiting the enclosure enters into the discharge plenum when the outlet gate is in the open position. A plurality of dust outlets are connected to dust ducts and configured to carry lofted material to a desired location external to the enclosure, with at least one of the dust outlets being in at least one modular section and at least one of the dust outlets being in the discharge plenum.

In certain embodiments, the apparatus further includes a feed hopper in communication with the inlet end through the inlet gate, the feed hopper being configured to deliver material onto the sliding bed when the inlet gate is in the open position.

In certain embodiments, the air movement apparatus includes a blower configured to deliver air or gas flow into the enclosure through an air inlet in the lower portion of at least one modular section, and the through a plurality of air distribution diffusers in a platform below the sliding bed.

In certain embodiments, the discharge plenum houses a rotatable star discharge wheel. In certain embodiments, the apparatus further includes a plurality of bed rakes on the sliding bed configured to slow movement of material along the sliding bed. In certain embodiments, the apparatus further includes a dust collection apparatus connected to at least one of the dust outlets by a dust duct. In certain embodiments, the apparatus further includes a conveyor connected to at least one of the dust outlets by a dust duct.

Further provided is a method for dedusting coal or other material, the method including the steps of (i) feeding material into an enclosure having side walls, a top wall in a top portion, a bottom wall in a bottom portion, an inlet end, and an outlet end, the enclosure housing a sliding bed disposed at an acute angle declined from the horizontal in the direction from the inlet end to the outlet end, where the sliding bed includes a plurality of slats extending laterally between the side walls from the inlet end to the outlet end; (ii) generating a zone of pressure atop the slats; and (iii) as the material travels down the sliding bed in the direction from the inlet end to the outlet end, separating the material into lofted material and non-lofted material. In certain embodiments, the material is selected from the group consisting of coal, upgraded coal, and frac sand.

In certain embodiments, the method further includes the steps of collecting the lofted material in a bag house. In certain embodiments, the acute angle is from about 20 degrees to about 50 degrees declined from the horizontal. In certain embodiments, the material is fed into the enclosure at a bed depth on the sliding bed of from about 6 inches to about 9 inches. In certain embodiments, the zone of pressure is generated by blowing air or gas into the enclosure at a rate of from about 500 ACFM to about 700 ACFM per square foot of slats.

DETAILED DESCRIPTION OF THE INVENTION

Figure 1:
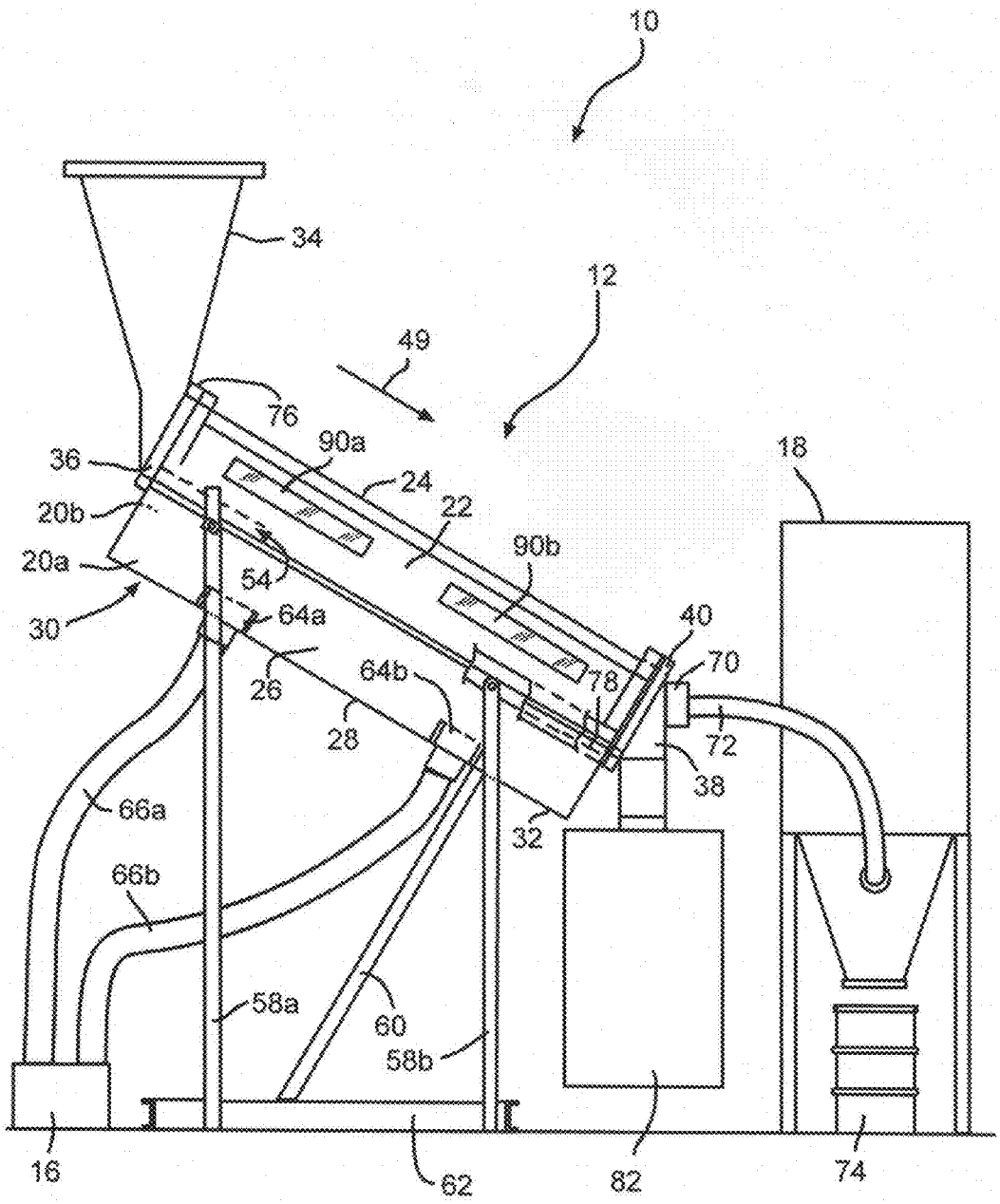
FIG. 1 is an elevational view of a first embodiment of an apparatus for handling coal.

Various embodiments are described in the present disclosure in the context of coal dedusting. Those of ordinary skill in the art will realize that the following detailed description of the embodiments is illustrative only and not intended to be in any way limiting. Other embodiments will readily suggest themselves to such skilled persons having the benefit of this disclosure. References to an "embodiment," "aspect," or "example" in this disclosure indicate that the embodiments of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Provided are an apparatus and method for handling coal or other materials. Though coal is often referred to for illustrative purposes, the apparatus is in no way limited to use with coal. The apparatus improves handling and dust emissions of a wide variety of materials where the presence of dust presents a handling or economic problem. Such materials include, but are not limited to, mineral material, coal (including low rank coals and upgraded coals), iron fines, and frac sand.

As seen in FIGS. 1-4, the apparatus 10 generally includes an enclosure 12 with a sliding bed 14 on which coal 2 moves while smaller particles 4 are lofted (that is, become airborne) with the aid of a pressure differential. In one embodiment, a flow of air or other gas is created at the sliding bed 14 from air or gas flow supplied by an air movement apparatus 16, such as a blower, through openings 50 in the enclosure 12 and sliding bed 14. The apparatus 10 can be connected to a dust collection apparatus 18 such as a bag house for collecting smaller particles 4 of coal that are lofted while moving on the sliding bed 14, effectively removing a substantial portion of the unwanted dust particles from the coal. The dedusted coal product 6 can be collected upon exiting the enclosure.

The enclosure 12 is generally elongate with side walls 20*a*, 20*b*, and divided between a top portion 22 having a top wall 24 and a bottom portion 26 having a bottom wall 28, though other configurations are possible. The enclosure 12 can be fabricated from any suitable material, such as, but not limited to, sheet metal, carbon steel, or alloy steel. The enclosure 12 has an inlet end 30, for receiving coal, and an outlet end 32, for discharging coal. A feed hopper 34 can be configured at the inlet end 30 to feed coal into the enclosure 12, though other methods of introducing coal into the enclosure 12 are possible. The feed hopper 34 is generally downwardly converging in shape, and communicates with the inlet end 30 of the enclosure typically through a first slide gate, or inlet gate 36, that can be raised or lowered to meter the depth 54 of coal flowing into the enclosure 12, also referred to as the bed depth 54. The inlet gate 36 can be a slide gate, a hinged door, or any other structure that would meter the amount of coal going through it. A discharge plenum 38 is positioned at the outlet end 32, and communicates with the enclosure typically through a second slide gate, or outlet gate 40, that can be raised or lowered to control the exit of coal from the enclosure. When the outlet gate 40 is open, coal moves from the sliding bed 14 out of the enclosure 12 and into the discharge plenum 38.

Figure 4:
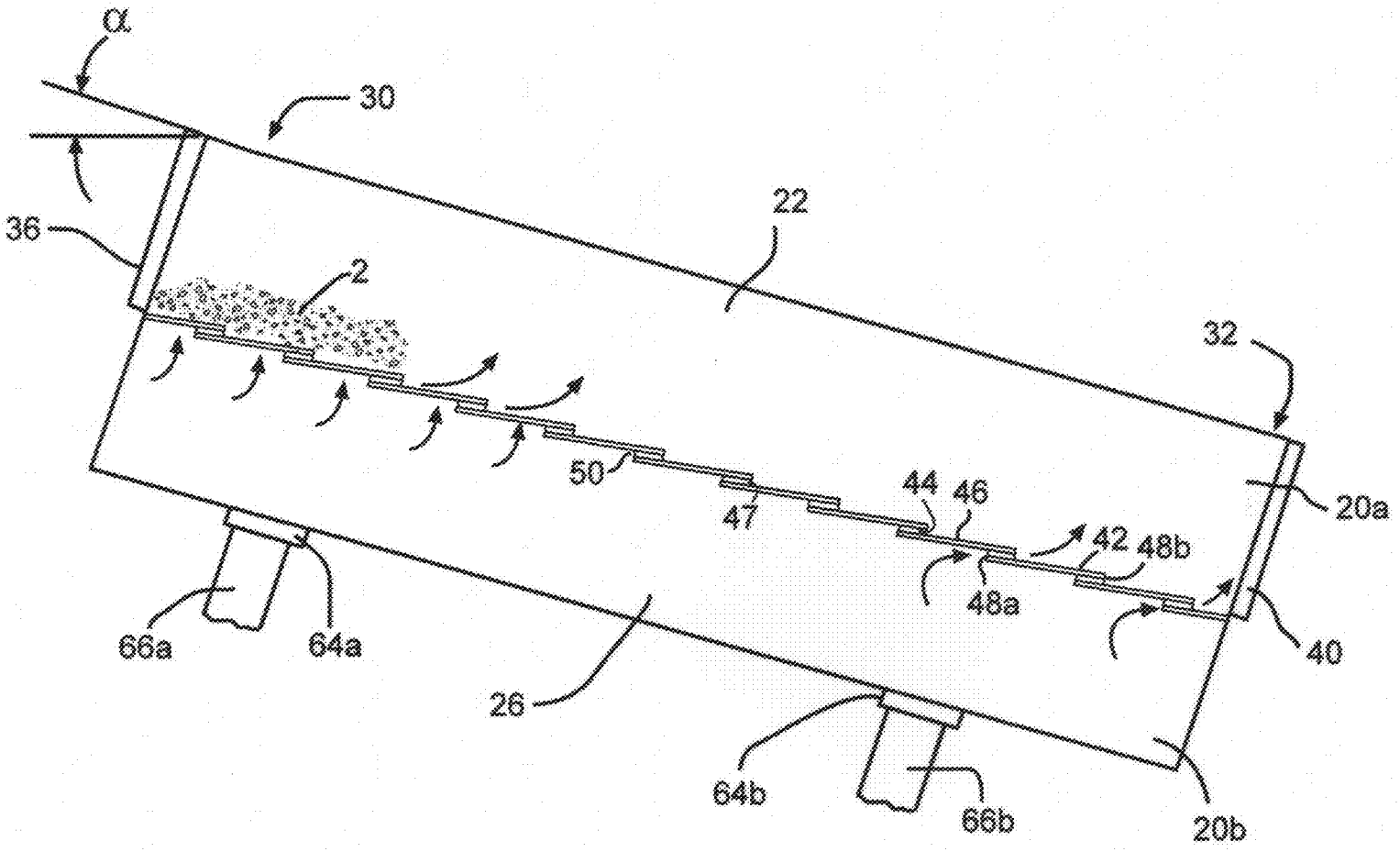
FIG. 4 is a cut-away view in elevation of the enclosure of an apparatus for handling coal. Arrows depict the flow of air or gas.

The enclosure 12 houses a sliding bed 14 composed of a series of slats 42. The slats 42 extend laterally between the side walls 20*a*, 20*b*, from the inlet end 30 of the enclosure 12 to the outlet end 32 of the enclosure 12. In certain non-limiting examples, the slats 42 are about 2 inches wide and are metal, but other dimensions and materials are possible. As depicted in FIG. 4, the slats 42 are rectangular members characterized by a long leading edge 44, a long trailing edge 46, and two short edges 48*a*, 48*b*. The slats 42 are attached by their short edges 48*a*, 48*b* to the side walls 20*a*, 20*b* of the enclosure 12, with spacers 47 in between them, at decreasing elevations, in the direction of material travel 49 through the enclosure 12, such that the leading long edge 44 of each slat 42 (except for the lower-most slat) overlaps but does not touch the trailing long edge 46 of the slat 42 immediately below. Consequently, the sliding bed 14 is oriented at angle $\alpha$ declined from the horizontal. The angle $\alpha$ is generally about the angle of repose for the material to be dedusted. In one embodiment, the angle $\alpha$ is within a range of from about 20 degrees to about 60 degrees declined from the horizontal. In one non-limiting example, the angle $\alpha$ is about 30 degrees declined from the horizontal.

The slats 42 are arranged to define openings 50, or gratings, for the admission of air or other gases through the sliding bed 14. The openings 50 are formed by the spaces between adjacent slats 42, and are typically uniform in size. The openings 50 are of a size and shape that substantially prevent coal solids from entering the openings 50, but that allow for passage of sufficient air or gas flow through the sliding bed 14 to create a flow of air or gas above the sliding bed 14 that helps the coal slide. The size of the openings 50 is determined by the height of the spacers 47, and generally ranges from about 1/16 inch to about 1/2 inch. In one non-limiting example when the apparatus is used for coal or upgraded coal, the spacers 47 are about 1/8 inch high, resulting in openings 50 that are about 1/8 inch wide. The amount of pressure required is a function of the bed depth 54 of the coal. The openings 50 allow for a pressure differential between the bottom portion 22 and top portion 26 of the enclosure 12, such that a zone of air pressure is created atop the slats 42. The pressure differential above the slats is generally about 4±2 inches of water.

Figure 2:
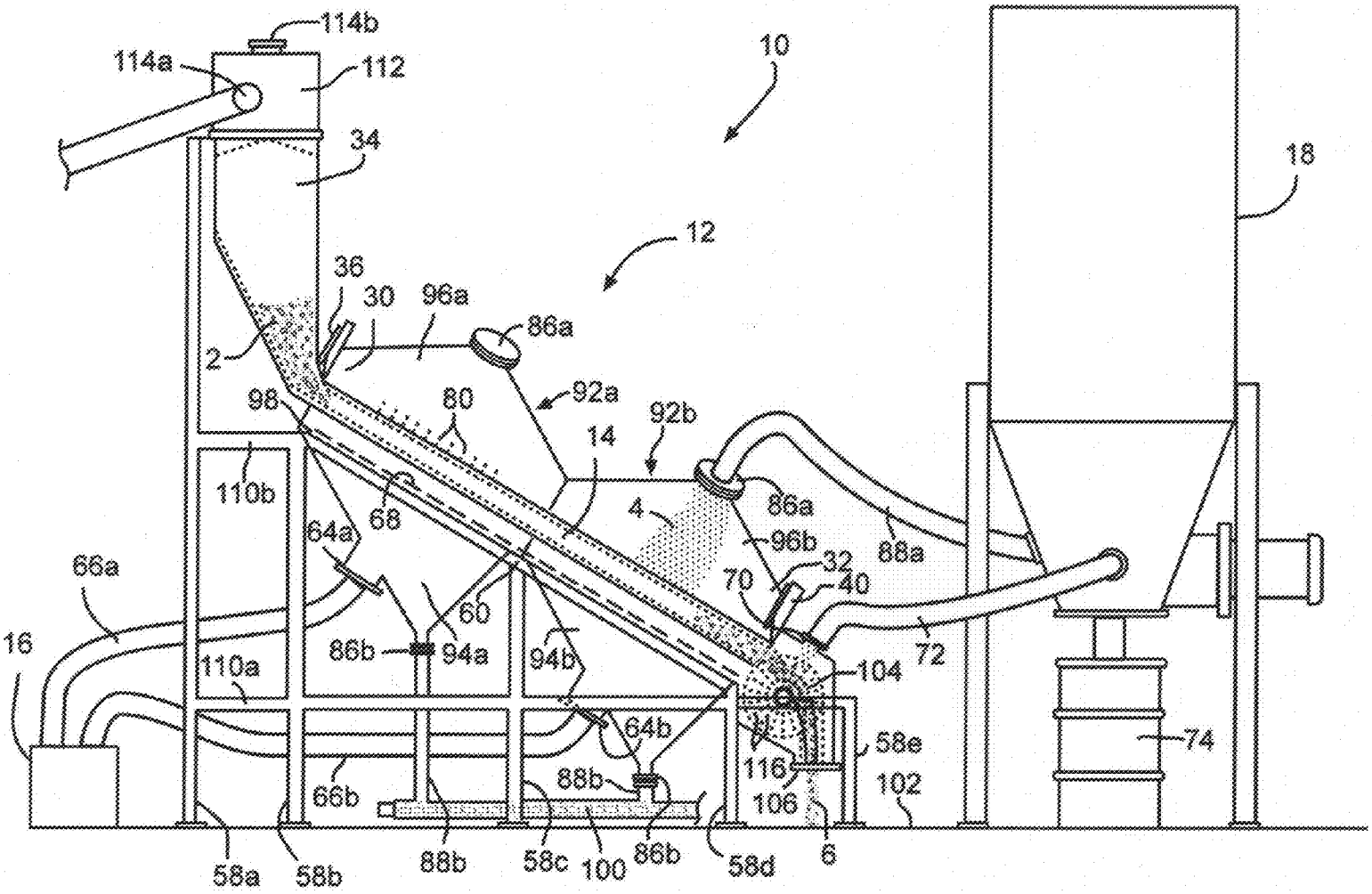
FIG. 2 is an elevational view partly in perspective of a second embodiment of an apparatus for handling coal.

The sliding bed 14 is configured at an acute angle $\alpha$ declined from the horizontal, generally at an angle of from about 20 to about 50 degrees, or from about 25 degrees to about 40 degrees, declined from the horizontal, in the direction from the inlet end 30 to the outlet end 32. The acute angle $\alpha$ of the sliding bed 14 is typically set to an angle slightly above the angle of repose of the material to be dedusted, such that the material slides from the inlet end 30 to the outlet end 32 under the influence of gravity. However, the angle $\alpha$ can be substantially the same as the angle of repose of the material to be dedusted. In certain embodiments, the sliding bed is configured at a 30-degree angle declined from the horizontal. Although the sliding bed 14 is declined from the horizontal, the enclosure 12 itself can be, but does not need to be, situated at an acute angle declined from the horizontal to accommodate the declined sliding bed 14. When the enclosure 12 can be situated at an acute angle declined from the horizontal, as depicted in FIG. 1 and FIG. 2, the enclosure 12 is supported by a frame 56 of legs 58 and support beams 60, any of which may be adjustable in height to change the angle of decline a. The frame 56 may also have a base 60 on the floor 102.

An air movement apparatus 16 is utilized to generate a pressure differential between the bottom portion 22 of the enclosure 12 and the top portion 26 of the enclosure 12. This pressure differential reduces friction and aids in movement of the coal 2 along the sliding bed 14. Suitable air movement apparatuses include, but are not limited to, blowers that provide air or gas flow into the bottom portion of the enclosure, and vacuums that provide a negative pressure in the top portion of the enclosure. In certain embodiments, air is provided into the enclosure by a blower 16 through one or more air inlets 64, or blower ports, in the bottom wall 28 of the enclosure 12. Though air is mentioned for illustrative purposes, other suitable processing fluids useable in the apparatus include, but are not limited to, nitrogen, carbon dioxide, steam, methane, noble gases such as argon or helium, and products of natural gas combustion.

The air inlets 64 can also be in the side walls 20*a*, 20*b* of the enclosure so long as they are still in the bottom portion 26. The air or gas flow is generally set to a velocity below the fluidizing velocity so that the sliding bed 14 does not fluidize. If the sliding bed 14 were to fluidize, the coal would slide through the enclosure 12 too quickly to be dedusted efficiently. By way of a non-limiting example, the blower 16 can be a 7 horsepower blower capable of 1200 actual cubic feet per minute (ACFM), though many other blowers are possible. The air or gas is conducted through spiral wound ducts 66*a*, 66*b* into the enclosure 12 through the air inlets 64*a*, 64*b*, and in certain embodiments, through one or more air distribution diffusers 68 below the slats 42. The air or gas flows through the openings 50 in the sliding bed 14, and creates a localized zone of air pressure that reduces friction and enhances the sliding of the coal across the top edges 48*b* of the slats 42.

As coal 2 passes the gratings 50 on the sliding bed 14 when a pressure differential has been generated, small dust-sized particles 4 are lofted (that is, become airborne), leaving behind larger coal pieces 6 to exit through the discharge plenum 38 and be collected. The lofted material 4, consisting of entrained particles and processing fluid (air or gas), is drawn through one or more dust outlets 70 located above the discharge plenum 38 and/or in the enclosure, and transported by dust ducts 72 to a dust collection apparatus 18 or other desired location. One non-limiting example of a dust collection apparatus is a bag house. When activated, a bag house 18 provides a negative pressure within the enclosure 12 and minimizes the leakage of dust particles 4 by preventing the dust particles 4 from going down the openings 50 and from getting stuck in joints of the enclosure. Once the entrained particles 4 and processing fluid are collected in the bag house 18, the bag house 18 separates the dust 4 from the processing fluid. The dust 4 can then be collected in a dust collection drum 74, or any other suitable apparatus.

In use, the coal to be dedusted is allowed to flow through a slide-gated bed depth control zone 76, and onto the slats 42. The coal 2 can be introduced into slide-gated depth control zone 76 through the use of a feed hopper 34 connected to the enclosure 12, or by any other suitable feeding apparatus. It is to be understood that coal can be fed into the apparatus 10 by manually loading the coal into the apparatus 10. Once the coal 2 enters the enclosure 12 from the feed hopper 34, the coal 2 slides through the enclosure 12 from the inlet end 30 to the outlet end 32 on the sliding bed 14. The non-lofted coal 6 exits the enclosure into the discharge plenum 38. Various elements optionally can be introduced to the sliding bed 14, such as a set of tines 78 or bed rakes 80, in order to limit or otherwise control the discharge speed of the dedusted coal before it passes off the slats 42 and enters the discharge plenum 38. The tines 78 or bed rakes 80 are generally elongated prongs that protrude upward from the sliding bed 14, and can be made of metal, plastic, or any other suitable material.

The discharge plenum 38 includes a dust outlet 70 which can be connected via a dust duct 72 to a dust collection apparatus 18. Optionally, the dust outlet 70 can be capped instead of connected to a dust collection apparatus 18, in order to control the flow of exiting dust. The discharge plenum 38 can also be connected to a product collection apparatus 82, such as a product recovery drum 82, for the collection of non-lofted material 6 exiting the enclosure 12. Alternatively, the non-lofted material 6 can fall by gravity from the discharge plenum 38 onto a conveyor, not shown, for transport to a desired location. The lofted material 4, which is a mixture of entrained coal particles and air or gas, exits the discharge plenum 38 through the dust outlet 70 when not capped, and is carried by a dust duct 72 into a dust collection apparatus 18. Optionally, the dust collection apparatus 18 can then separate the entrained particles from the air or gas. Suitable dust collection apparatuses include, but are not limited to, bag houses, mechanical precipitators, electrostatic precipitators, and cyclones.

In some embodiments, the enclosure can have one or more enclosure dust outlets 86*a*, 86*b* in the top wall 24 and/or bottom wall 28 of the enclosure 12. Each enclosure dust outlet 86*a*, 86*b* can either be capped or connected to an enclosure dust duct 88*a*, 88*b* that removes lofted material 4 from inside the enclosure 12. The enclosure dust outlets 86*a*, 86*b* can be utilized instead of, or in addition to, the dust outlet 70 in the discharge plenum 38 that removes lofted material 4 once it reaches the discharge plenum 38. Accordingly, enclosure dust outlets 86*a*, 86*b* can remove lofted material 4 before it reaches the discharge plenum 38.

The various functions of the apparatus can be automated using electronic control systems as can be appreciated by those skilled in the art. For example, the opening and closing of the inlet gate 36 and outlet gate 40 can be controlled remotely, as well as the functioning of the air movement apparatus 16 and dust collection apparatus 18. In one non-limiting example, the apparatus 10 includes a processor module with an output of 45 tons per hour. In a non-limiting example of dimensions, the apparatus is approximately 4 feet wide and 10 feet long for a 6-inch coal bed depth, and has a total fan capacity of 6000 ACFM. In more non-limiting examples, the spacers 47 are about ½ inch long by about ½ inch wide, and are about 1/16 inch high. Optionally, windows 90*a*, 90*b* along the axis of material travel 49 give the user a visual indication as to the bed depth and the dynamic action of dedusting.

In order to maximize dedusting and minimizing entrainment of larger particles, any combination of a number of variables can be adjusted. The air flow or gas flow is generally maintained so as to loft the maximum amount of dust, while minimizing the entrainment of larger (>150 μm) particles which pose no product dust problem. The air flow or gas flow can be increased or decreased as desired. The bed depth 54 can be adjusted by use of the inlet gate 36. The dust outlet 70 can be capped or connected to a dust collection apparatus 18 that provides a negative pressure within the enclosure 12. The number and locations of the air inlets 64 can be varied. The size, number, shape, and configuration of the tines 78 or bed rakes 80 can be adjusted or customized. For instance, bed rakes 80 can be arranged on the sliding bed 14 in a straight line in the direction of material travel 49, or in a disordered array.

Thus, many variations are possible, and the many possible configurations can be utilized in order to tailor the apparatus 10 for different desired functions. Given the ability and customization of the present disclosure, the sliding bed apparatus is superior to other dedusting methods in terms of ease of construction, operation, maintenance, cost, and efficiency of dedusting.

Referring now to FIG. 1, an embodiment of the apparatus 10 has an elongated enclosure 12 with side walls 20*a*, 20*b*, a top wall 24, a bottom wall 28, an inlet end 30 for receiving coal having an inlet gate 36, and an outlet end 32 having an outlet gate 40. A feed hopper 34 is connected to the inlet end 30 of the enclosure 12 by way of the inlet gate 36, and a discharge plenum 38 is connected to the outlet end 32 of the enclosure 12 by way of the outlet gate 40. When the inlet gate 36 is opened, coal 2 in the feed hopper 34 can move from the feed hopper 34 into the enclosure 12. The degree to which the inlet gate 36 is opened determines the resulting bed depth 54 of coal inside the enclosure 12. The enclosure 12 has optional viewing windows 90*a*, 90*b* along the axis of material travel for user convenience, giving a visual indication as to the bed depth 54 and the dynamic action of dedusting.

Inside the enclosure 12 is a sliding bed 14 of slats 42, situated at about a 30 degree angle declined from the horizontal in the direction from the inlet end 30 to the outlet end 32. The slats 42 are about 2 inches wide, and are arranged to allow air or gas flow through openings 50 between the slats 42. The sliding bed 14 serves to divide the enclosure 12 into a top portion 22 and a bottom portion 26. The enclosure 12 is suspended in the air at the angle of the sliding bed, declined from the horizontal, by a frame 56 having a base 62, legs 58*a*, 58*b*, and support beam 60. Near the outlet end 32 of the enclosure 12, the sliding bed 14 includes a set of tines 78 to slow the flow of coal out of the enclosure 12. The tines 78 limit the discharge speed of the dedusted coal 6 before it passes off the slats 42 into the discharge plenum 38 and then is collected in the product recovery drum 82.

The enclosure 12 has two blower ports 64*a*, 64*b* for entry of air or gas flow into the enclosure from a blower 16. In use, a blower 16 is operated to blow air or gas into the bottom portion 26 of the enclosure 12 through spiral wound ducts 66*a*, 66*b* into the blower ports 64*a*, 64*b*. The air or gas flow enters the top portion 22 of the enclosure 12 through openings 50 between the slats 42 in the sliding bed 14, thereby creating a cushion of air or gas above the sliding bed 14.

When the outlet gate 40 is opened, non-lofted coal 6 exiting the enclosure 12 enters the discharge plenum 38. The discharge plenum 38 includes a dust outlet 70, or bag house collection port, which is connected by a dust duct 72 to a bag house 18 for the collection of lofted material 4. The bag house 18 may be activated to provide a negative pressure inside the enclosure 12, which aids in preventing leakages. The discharge plenum 38 is also connected to a product recovery drum 82, for the collection of non-lofted material 6.

In use, coal 2 moves from the inlet gate 36 down the sliding bed 14 through the length of the enclosure 12, exiting through the outlet gate 40 into the discharge plenum 38. During the process of moving through the enclosure 12 on the sliding bed 14 with an air or gas cushion 8 created by air or gas flow from the blower 16, smaller coal particles 4 are lofted. Once in the discharge plenum 38, the lofted material 4 exits into the bag house 18 through the dust outlet 70 and dust duct 72 attached thereto, while the non-lofted coal 6 exits the discharge plenum 38 into the product recovery drum 82 by force of gravity.

Figure 3:
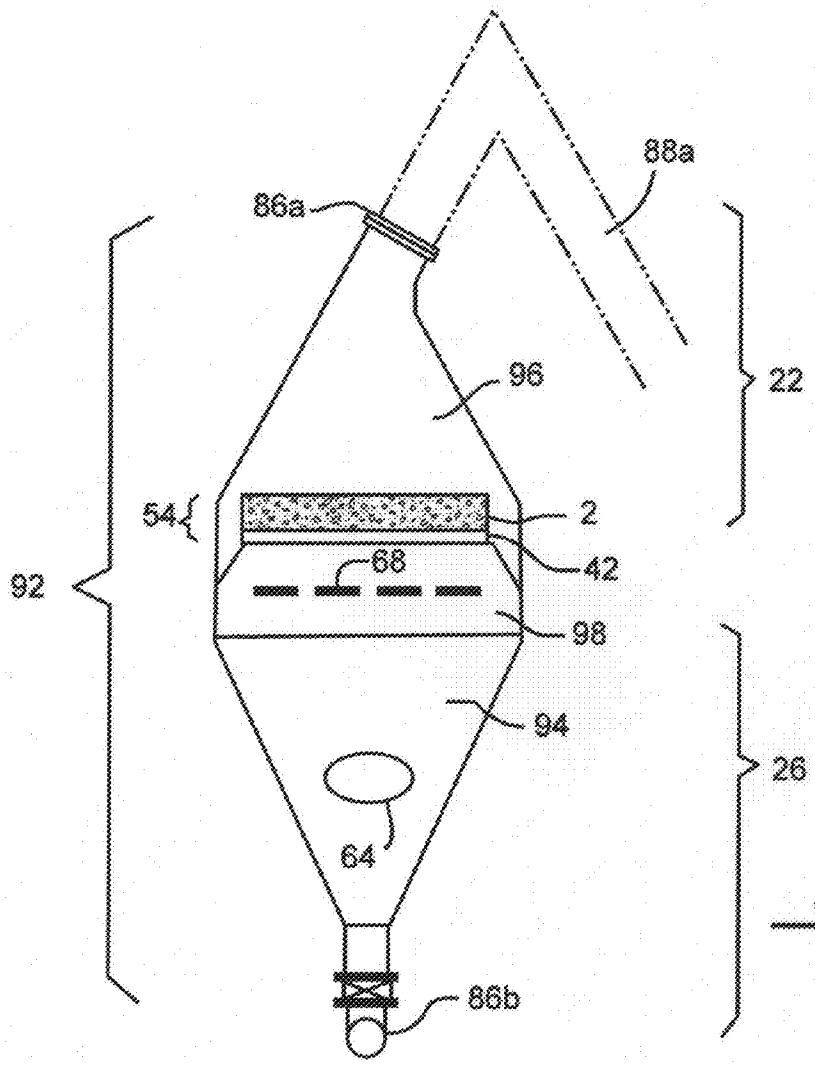
FIG. 3 is a cross-sectional view of a modular section of the enclosure of an apparatus for handling coal.

Referring now to the embodiment shown in FIG. 2, the dedusting apparatus has an enclosure configured in two modular sections 92*a*, 92*b*. A cross-sectional view of a modular section 92 of the enclosure 12 is shown in FIG. 3. Each modular section 92*a*, 92*b* has a downwardly tapering lower portion 94*a*, 94*b* and an upwardly tapering upper portion 96*a*, 96*b* separated by the sliding bed 14 and a platform 98 below the sliding bed 14. The platform 98 has several air distribution diffusers 68. The upper portion 96 has an upper enclosure dust outlet 86*a* connected to an upper enclosure dust duct 88*a*, and the lower portion 94 has an air inlet 64 where air or gas flow enters the enclosure 12 from a blower 16 through spiral wound ducts 66*a*, 66*b*. The lower portion 94 of each modular section 92 also has a lower enclosure dust outlet 86*b* connected by a lower enclosure dust duct 88*b* to a screw conveyor 100 for transport of the dust 4 to a desired location. The lower enclosure dust outlets 86*b* generally collect dust 4 that falls from the upper portion 96 into the lower portion 94 through the openings 50 in the slats 42 and the air distribution diffusers 68.

The sliding bed 14 has a plurality of slats 42 extending laterally through the length of the enclosure 12. The sliding bed 14 optionally has a series of bed rakes 80 to limit the speed at which coal moves through the enclosure 12. The sliding bed 14 and the enclosure 12 are configured at an acute angle $\alpha$ declined from the horizontal in the direction of the inlet end 30 to the outlet end 32. The acute angle $\alpha$ is greater than the angle of repose, or the angle of slide, for the material to be dedusted. In one embodiment, the acute angle $\alpha$ is sufficiently large to cause the coal to slide down the sliding bed 14 in substantially a plug flow manner.

The enclosure 12 has an inlet end 30 with an inlet gate 36 moveable between an open position and a closed position, and an outlet end 32 with an outlet gate 40 moveable between an open position and a closed position. The inlet and outlet gates 36, 40 can be adjusted to any position between fully open and fully closed. When the inlet gate 36 is opened, coal can enter the enclosure 12 from a feed hopper 34. The degree to which the inlet gate 36 is opened determines the resulting bed depth 54 of coal inside the enclosure 12. Once coal 2 enters the enclosure, the force of gravity causes movement of the coal 2 on the sliding bed 14 in the direction toward the outlet end 32 of the enclosure 12.

The bottom portion 26 of the enclosure has two air inlets 64*a*, 64*b*, one in each modular section 92*a*, 92*b*, through which the blower 16 delivers air or gas flow into the enclosure 12. Once in the enclosure 12, the air or gas flows through air distribution diffusers 68 in the lower portion 94*a*, 94*b* of each modular section 92*a*, 92*b*, below the sliding bed 14. The air or gas then passes through the openings 50 in the sliding bed 14, creating an air or gas cushion 8 above the sliding bed 14. Movement of the coal 2 through the enclosure 12 is aided by the air or gas cushion 8 above the sliding bed 14.

The top portion 22 of the enclosure 12 has two upper enclosure dust outlets 86*a* one in each modular section 92*a*, 92*b*. The upper enclosure dust outlets 86*a*, 86*b* can be connected to upper enclosure dust ducts 88*a* or can be capped. When connected, the upper enclosure dust ducts 88*a* transport lofted material 4 from inside the enclosure to a desired location external to the enclosure 12, such as a dust collection apparatus 18 or screw conveyor 100.

The bottom portion 26 of the enclosure 12 also has two lower enclosure dust outlets 86*b*, one in each modular section 92*a*, 92*b*. The lower enclosure dust outlets 86*b* can be capped or connected to lower enclosure dust ducts 88*b* that transport lofted coal 4 from inside the enclosure to a screw conveyor 100 external to the enclosure 12. The screw conveyor 100 can be disposed on the floor 102 or elsewhere, and can be configured to deliver the dust 4 to a desired location. Alternatively, the lower enclosure dust ducts 88*b* can transport the lofted coal 4 directly to a bag house 18 or other dust collection apparatus. The lower enclosure dust outlets 86*b* are useful for removing from the enclosure 12 dust 4 that has fallen from the top portion 22 into the bottom portion 26 through the air distribution diffusers 68.

The outlet end 32 of the enclosure 12 has an outlet gate 40 that can be closed or opened. When opened, the coal slides out of the enclosure 12 into the discharge plenum 38, which houses a star wheel discharge 104. The star wheel discharge 104 is a wheel rotatable about an axis perpendicular to the direction of movement 49 of the coal. The star wheel discharge 104 can have any of a number of suitable configurations, and acts to slow the exit of dedusted coal 6 from the discharge plenum 38. In general, the star wheel discharge has a plurality of blades 116 that can be turned by action of the coal falling by gravity through the discharge plenum 38, or can be turned mechanically by means of a gear train, not shown. The rate of rotation of the star wheel discharge 104 can be adjusted to change the speed with which the dedusted coal 6 exits the discharge plenum 38. It is to be understood that various other devices, such as, but not limited to, a vibrating table, can be utilized in place of the star wheel discharge 104 to control the rate at which coal flows through the apparatus 10. Furthermore, it is not necessary for any apparatus for controlling the rate of coal flow to be present in the discharge plenum 38.

The discharge plenum 38 has a dust outlet 70 that can be capped or connected to a dust duct 72 that transports lofted coal 4 from the discharge plenum 38 to a dust collection apparatus 18, to the screw conveyor 100, or to another desired location. This embodiment of the apparatus 10 thus removes dust from both inside the enclosure 12, through the upper and lower enclosure dust outlets 86*a*, 86*b* in each modular section 92*a*, 92*b*, and outside the enclosure 12, through the dust outlet 72 in the discharge plenum 38.

In use, air or gas flows into the bottom portion 26 of the enclosure 12 through the air inlets 64 in the lower portion 94 of each modular section 92*a*, 92*b*, then into the top portion 22 of the enclosure 12 through the air distribution diffusers 68 and openings 50 between the slats 42 in the sliding bed 14, thereby creating a cushion of air or gas above the sliding bed 14. The coal moves down the sliding bed 14 from the inlet gate 36 through the length of the enclosure 12, exiting through the outlet gate 40 into the discharge plenum 38. During the process of moving through the enclosure 12 on the sliding bed 14, smaller particles 4 of the coal 2 are lofted. The lofted coal 4 exits the enclosure 12 through the enclosure dust outlets 86*a*, 86*b* in either of the modular sections, or exits the enclosure 12 into the discharge plenum 38 and through the dust outlet 70 in the discharge plenum 38. Non-lofted coal 6 passes through the star wheel discharge 104, which sends the non-lofted coal 6 out a discharge plenum outlet 106. A product recovery drum 82 can be situated below the discharge plenum outlet 106 to collect the non-lofted coal 6. Alternatively, the non-lofted coal 6 can fall from the discharge plenum outlet 106 to a conveyor for transport to a desired location.

The apparatus is supported by a frame 56 of legs 58*a*, 58*b*, 58*c*, 58*d*, 58*e* and support beams 60, 110*a*, 110*b*. The enclosure 12 sits on a diagonal support beam 60 parallel to the acute angle $\alpha$ of the sliding bed 14. Secondary support beams 110*a*, 110*b* connect the various legs 58 in order to stabilize the apparatus 10. The frame 56 also includes a feed hopper housing 112 for delivering a coal feed into the feed hopper 34 through feed inlets 114*a*, 114*b*.

EXAMPLES

A sliding bed apparatus, as depicted in FIG. 1, was tested with 8 drums of K-Fuel, which is a refined coal product. Conditions were varied to test for dedusting efficiency. The flow ranged from 200 to 800 ACFM, and the bed depth varied from 6 to 9 inches.

Static beds were run to ascertain the conditions which would precipitate channeling and acquire baseline dust removal. Pressure drop was recorded and the change in pressure between a moving and a non-moving bed was noted. The flow through the unit was varied by adjusting a butterfly valve downstream from the blower as well as setting a slide gate at the blower intake.

Coal product was received in 55-gallon drums and then transferred to 5-gallon pails for weighing and easy filling of the hopper above the sliding bed. A sample of 2 kg per test run was set aside to allow comparison with samples taken after dedusting. Upon filling the hopper, the inlet slide gate was raised and the material was allowed to partially fill the slat bed. The bag house was activated to collect dust and provide a slight negative pressure above the bed, thereby minimizing leakage of lofted particles into the area between the slats. The blower was energized.

Testing was conducted at two selected bed depths of 6 inches and 9 inches, and two selected air or gas flow rates of 500 ACFM and 700 ACFM. Prior to testing, a hydraulic jack was used to adjust the unit's incline from a steep (that is, near-vertical) angle to a lesser angle. The incline was adjusted slowly to allow control over the precise angle where the material would begin to slide by action of the air or gas cushion partially lofting the bed, thus reducing friction and allowing movement. As material passed the gratings, small dust-sized particles were lofted, leaving the larger product to continue down the bed and into the recovery drum.

The apparatus was allowed to run until the hopper was empty and all material had ceased to move on the gate. The blower was shut down, followed by the bag house. The bag house was pulsed with compressed air for 15 minutes while the product recovery drum was detached, and a sample of the dedusted material was taken to evaluate dedusting efficiency. After pulsing, the collection drum beneath the bag house was detached, and the material was removed and weighed. A sample was also taken to determine the size fractions removed.

Figure 5:
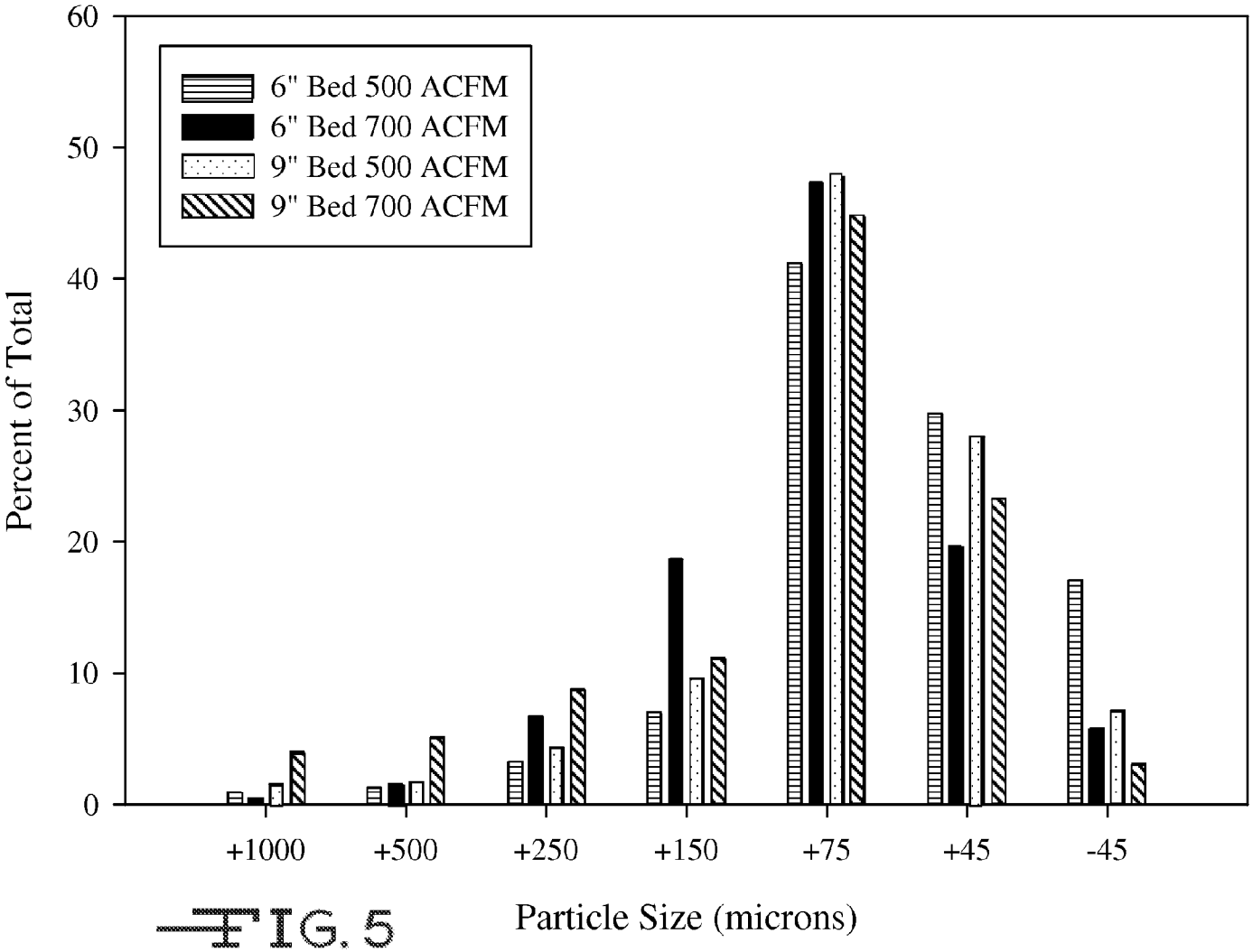
FIG. 5 is a graph showing the size distribution of material removed from feed coal in a non-limiting example. The colors denote the particular bed depth and air flow rate.

Evaluations of the apparatus at various conditions demonstrated that shallow beds and high air flows are the most effective in removing coal dust. The combination of a 6-inch bed depth and an air flow of 700 ACFM resulted in a removal of greater than 70% of the 75 μm and smaller particles. At these conditions, a total of 1.72% of the K-Fuel feed was removed as dust. The material recovered from the bag house contained the size distribution shown in FIG. 5. This represents the material removed from the feed coal.

Figure 6:
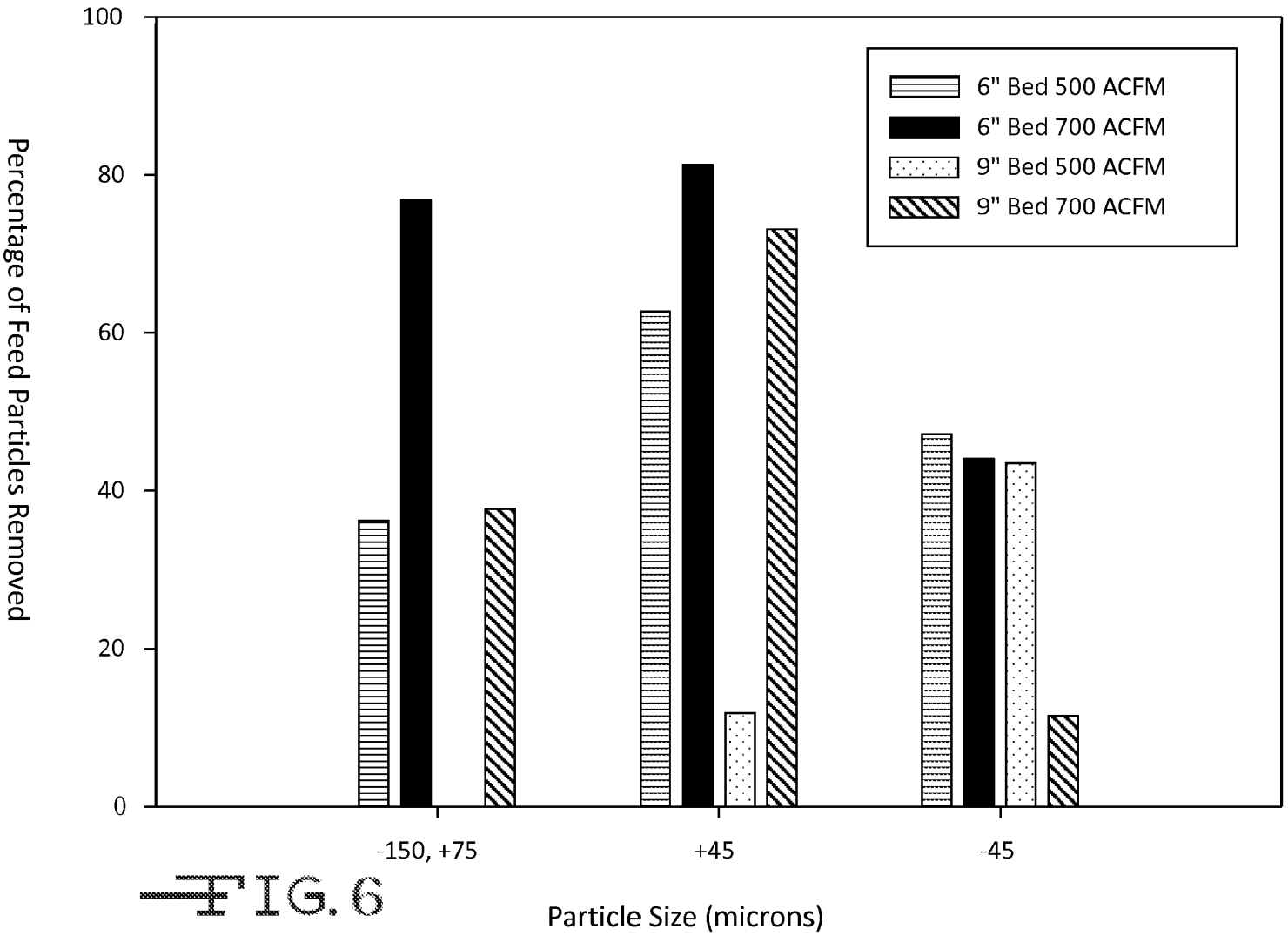
FIG. 6 is a graph showing the efficiency of fine particle removal in a non-limiting example. The colors denote the particular bed depth and air flow rate.

Coal particles having a size of 75 microns or less are more susceptible to lofting or dusting. The various test conditions were evaluated for their overall efficiency in removing these particles, with the results shown in FIG. 6 as a percentage of particles in the feed coal that were removed. As seen from FIG. 6, the 9" bed at the 500 ACFM flow rate was ineffective at removing particles sized 75 microns or greater.

Removal of coal particles sized 150 microns and greater is not desirable, since these particles are not considered significant contributors to the dusting issue. Invariably, a limited number of these larger particles are entrained along with the smaller particles during the dedusting process. Table 1, below, summarizes the removal of these particles at varying test conditions.

TABLE 1

| Percent of Feed Removed as Dust | | | | |
|---|---|---|---|---|
| Bed depth | Air Flow (ACFM) | Percent of Feed Removed as Dust (All particles) | Percent of >150 μm Particles in Dust Removed | Percent of Feed Removed as >150 μm Particles |
| 6" | 500 | 0.48% | 12.26% | 0.06% |
| 6" | 700 | 1.72% | 27.38% | 0.47% |
| 9" | 500 | 0.67% | 17.16% | 0.11% |
| 9" | 700 | 0.91% | 29.03% | 0.26% |

Given the direct correlation between bed depth, air flow rate, and dust removal efficiency, the optimum operating conditions are realized when the material is allowed to flow through the sliding bed at a steady rate, with the thinnest bed allowed by throughput conditions and an airflow adjusted to keep larger particles from lofting. With a thicker bed, a higher airflow does not necessarily yield a higher dust removal. These factors are taken into consideration when customizing an apparatus for a desired purpose.

In the above examples, dedusting was most effective with a thinner bed and higher air flow. For 6" thick beds, with 500 ACFM, the percent decrease in 75 micron and smaller dust was 48%, with a total of 0.48% of the K-Fuel feed removed as dust. For 6" thick beds, with a 700 ACFM, the percent decrease in 75 micron and smaller dust was 72%, with a total of 1.72% of the K-Fuel feed removed as dust. For 9" thick beds, with 500 ACFM, the percent decrease in 75 micron and smaller dust was 3%, with a total of 0.67% of the K-Fuel feed removed as dust. For 9" thick beds, with 700 ACFM, the percent decrease in 75 micron and smaller dust was 46%, with a total of 0.91% of the K-Fuel feed removed as dust.

At the most extreme dedusting conditions (a combination of a 6" bed depth with 700 ACFM air flow), less than 0.5% of the larger (>150 μm) particles were removed from the K-Fuel feed. These larger particles pose no product dust problem. Instead, a majority of the dust removed was less than 150 microns in size, which is a size that tends to stay in the air once lofted. The dedusted product was easier to handle without lofting dust. Thus, these examples show that the sliding bed apparatus significantly aids in dedusting the K-Fuel product.

While the invention has been described with reference to multiple embodiments, it should be understood by those skilled in the art that various changes may be made and equivalents may be substituted without departing from the essential scope of the invention. In addition, many modifications may be made to adapt a particular situation or material to the teachings of the invention without departing from its essential scope. Therefore, it is intended that the invention not be limited to the particular embodiments disclosed in the present specification, but that the invention will include all embodiments falling within the scope of the claims.

What is claimed is:

1. An apparatus for handling material comprising:

an elongated enclosure with side walls, a top portion with a top wall, and a bottom portion with a bottom wall, and having an inlet end for receiving material with an inlet gate and an outlet end with an outlet gate, the enclosure housing a sliding bed that separates the top portion from the bottom portion, the sliding bed comprising a plurality of slats extending laterally between the side walls from the inlet end to the outlet end, the slats being spaced apart, thereby forming openings between adjacent slats, and the slats having a leading edge and a trailing edge, with the leading edges of the slats overlapping the trailing edges of the next adjacent slat, and the slats being fixed in position and not rotatable with respect to the elongated enclosure, wherein the sliding bed is disposed at an acute angle declined from the horizontal in the direction from the inlet end to the outlet end;

an air movement apparatus configured to generate a pressure differential across the sliding bed, with the pressure below the sliding bed in the bottom portion being higher than the pressure above the sliding bed in the top portion;

a discharge plenum at the outlet end through the outlet gate, wherein the discharge plenum is configured to receive material exiting the enclosure;

a dust outlet in communication with either the discharge plenum or the enclosure, or both, wherein the dust outlet is configured to direct lofted material exiting the enclosure to a desired location; and a collection apparatus in communication with the discharge plenum, wherein the collection apparatus is configured to collect non-lofted material exiting the discharge plenum.

2. The apparatus of claim 1, further comprising a feed hopper in communication with the inlet end through the inlet gate, the feed hopper being configured to deliver material onto the sliding bed when the inlet gate is in the open position.

3. The apparatus of claim 1, wherein the air movement apparatus comprises a blower configured to deliver air or gas flow into the enclosure through one or more blower ports in the bottom portion of the enclosure.

4. The apparatus of claim 3, wherein the blower is connected to the blower ports through spiral wound ducts.

5. The apparatus of claim 1, further comprising a plurality of tines on the sliding bed, the tines being configured to slow movement of material along the sliding bed.

6. The apparatus of claim 1, wherein the dust outlet is connected to a bag house through a dust duct.

7. The apparatus of claim 1, wherein the acute angle is from about 20 degrees to about 50 degrees declined from the horizontal in the direction from the inlet end to the outlet end.

8. An apparatus for handling material comprising:

an enclosure having two or more modular sections, an inlet end for receiving material with an inlet gate, and an outlet end with an outlet gate, the enclosure housing a sliding bed extending laterally from the inlet end to the outlet end and having a plurality of slats, the slats being spaced apart, thereby forming openings between adjacent slats, and the slats having a leading edge and a trailing edge, with the leading edges of the slats overlapping the trailing edges of the next adjacent slat, and the slats being fixed in position and not rotatable with respect to the elongated enclosure, wherein each modular section has a lower portion below the sliding bed and an upper portion above the sliding bed, the sliding bed is disposed at an acute angle declined from the horizontal in the direction from the inlet end to the outlet end;

an air movement apparatus configured to generate a pressure differential across the sliding bed, with the pressure below the sliding bed being higher than the pressure above the sliding bed in at least one of the two or more modular sections;

a discharge plenum in communication with the outlet end through the outlet gate, whereby material exiting the enclosure enters into the discharge plenum; and a plurality of dust outlets connected to dust ducts configured to carry lofted material to a desired location external to the enclosure, wherein at least one of the dust outlets is in at least one modular section and at least one of the dust outlets is in the discharge plenum;

wherein the slats are and spaced apart by openings, the slats being substantially horizontal to deliver gases through the openings in a substantially horizontal direction from the lower portion of the enclosure to the upper portion of the enclosure.

9. The apparatus of claim 8, further comprising a feed hopper in communication with the inlet end through the inlet gate, the feed hopper being configured to deliver material onto the sliding bed when the inlet gate is in the open position.

10. The apparatus of claim 8, wherein the air movement apparatus comprises a blower configured to deliver air or gas flow into the enclosure through an air inlet in the lower portion of at least one modular section, and through a plurality of air distribution diffusers in a platform below the sliding bed.

11. The apparatus of claim 8, wherein the discharge plenum houses a rotatable star wheel discharge.

12. The apparatus of claim 8, further comprising a plurality of bed rakes on the sliding bed, the bed rakes being configured to slow movement of material along the sliding bed.

13. The apparatus of claim 8, further comprising a dust collection apparatus connected to at least one of the dust outlets by a dust duct.

14. The apparatus of claim 8, further comprising a conveyor connected to at least one of the dust outlets by a dust duct.

15. A method of dedusting material, the method comprising:

feeding material into an enclosure having side walls, a top portion with a top wall, a bottom portion with a bottom wall, an inlet end, and an outlet end, the enclosure housing a sliding bed disposed at an acute angle declined from the horizontal in the direction from the inlet end to the outlet end, wherein the sliding bed divides the top portion from the bottom portion and comprises a plurality of slats extending laterally between the side walls from the inlet end to the outlet end the slats being spaced apart, thereby forming openings between adjacent slats, and the slats having a leading edge and a trailing edge, with the leading edges of the slats overlapping the trailing edges of the next adjacent slat, and the slats being fixed in position and not rotatable with respect to the elongated enclosure, wherein the material is selected from the group of coal, upgraded coal, frac sand, and iron fines;

generating a pressure differential across the sliding bed, with the pressure below the sliding bed being higher than the pressure above the sliding bed, wherein the pressure differential delivers gases through the sliding bed, with the gases traveling in a substantially horizontal direction though the sliding bed; and as the material travels down the sliding bed in the direction from the inlet end to the outlet, separating the material into lofted material and non-lofted material.

16. The method of claim 15, wherein the acute angle is from about 20 degrees to about 50 degrees declined from the horizontal.

17. The method of claim 15, wherein the material is fed into the enclosure at a bed depth on the sliding bed of from about 6 inches to about 9 inches.

18. The method of claim 15, wherein the zone of pressure is generated by blowing air or gas into the enclosure at a rate of from about 500 ACFM to about 700 ACFM per square foot of slats.

19. The method of claim 15, further comprising controlling the rate of travel down the sliding bed with a star wheel discharge or vibrating table.

20. The method of claim 15 in which the pressure differential is lower than that required to form the material into a fluidized bed.

21. The apparatus of claim 1 in which the openings extend laterally across the enclosure.

22. The apparatus of claim 1 in which the slats are overlapping to an extent sufficient to substantially prevent the material from entering the openings between adjacent slats in the event that the pressure differential is eliminated.

23. The apparatus of claim 8 in which the openings extend laterally across the enclosure.

24. The apparatus of claim 8 in which the slats are overlapping to an extent sufficient to substantially prevent the material from entering the openings between adjacent slats in the event that the pressure differential is eliminated.

* * * * *